US010697466B2

(12) United States Patent
Hakozaki et al.

(10) Patent No.: US 10,697,466 B2
(45) Date of Patent: Jun. 30, 2020

(54) SERIAL AXIAL FLOW FAN

(71) Applicant: Nidec Corporation, Kyoto (JP)

(72) Inventors: Shogo Hakozaki, Kyoto (JP); Ryota Yamagata, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 230 days.

(21) Appl. No.: 15/869,571

(22) Filed: Jan. 12, 2018

(65) Prior Publication Data

US 2018/0195525 A1 Jul. 12, 2018

Related U.S. Application Data

(60) Provisional application No. 62/445,355, filed on Jan. 12, 2017.

(30) Foreign Application Priority Data

Jan. 9, 2018 (JP) ..... 2018-000931

(51) Int. Cl.

| | |
|---|---|
| ***F04D 29/38*** | (2006.01) |
| ***F04D 19/00*** | (2006.01) |
| ***F04D 29/66*** | (2006.01) |
| ***F04D 29/68*** | (2006.01) |
| ***F04D 29/16*** | (2006.01) |

(Continued)

(52) U.S. Cl.

CPC ..... *F04D 29/384* (2013.01); *F04D 19/002* (2013.01); *F04D 19/007* (2013.01); *F04D 29/164* (2013.01); *F04D 29/646* (2013.01); *F04D 29/666* (2013.01); *F04D 29/681* (2013.01); *F04D 29/181* (2013.01); *F04D 29/52* (2013.01)

(58) Field of Classification Search

CPC ..... F04D 19/002; F04D 19/007; F04D 25/08; F04D 25/166; F04D 29/164; F04D 29/181; F04D 29/327; F04D 29/384; F04D 29/52; F04D 29/522; F04D 29/646; F04D 29/666; F04D 29/681

See application file for complete search history.

(56) References Cited

U.S. PATENT DOCUMENTS 7,275,911 B2 10/2007 Lee et al.
7,445,423 B2 * 11/2008 Ishihara ..... F04D 19/007 415/193

(Continued)

FOREIGN PATENT DOCUMENTS

CN 202560599 U 11/2012
JP 3993118 B2 10/2007

(Continued)

OTHER PUBLICATIONS

Hakozaki et al., "Serial Axial Flow Fan", U.S. Appl. No. 15/869,583, filed Jan. 12, 2018.

*Primary Examiner* — Patrick Hamo
*Assistant Examiner* — Joseph S. Herrmann
(74) *Attorney, Agent, or Firm* — Keating & Bennett

(57) ABSTRACT

A serial axial flow fan in which an end portion of a first axial flow fan on an exhaust side, and an end portion of a second axial flow fan on an intake side are connected to each other. At least either of a plurality of first blades of a first impeller of the first axial flow fan, and a plurality of second blades of a second impeller of the second axial flow fan are provided with auxiliary blade portions.

12 Claims, 8 Drawing Sheets

(51) Int. Cl.

| | |
|---|---|
| ***F04D 29/64*** | (2006.01) |
| *F04D 29/52* | (2006.01) |
| *F04D 29/18* | (2006.01) |

(56) References Cited

U.S. PATENT DOCUMENTS

| | | | | |
|---|---|---|---|---|
| 8,079,801 | B2 * | 12/2011 | Yoshida | F04D 25/0613 415/199.5 |
| 8,123,461 | B2 * | 2/2012 | Yoshida | F04D 25/0613 415/214.1 |
| 8,210,795 | B2 | 7/2012 | Lin et al. | |
| 8,231,343 | B2 * | 7/2012 | Kayama | F04D 25/0613 415/220 |
| 8,727,717 | B2 | 5/2014 | Hsu et al. | |
| 8,764,375 | B2 * | 7/2014 | Kato | F04D 19/002 415/68 |
| 9,267,505 | B2 * | 2/2016 | Yanagisawa | F04D 19/007 |
| 2009/0035154 | A1 | 2/2009 | Hsu et al. | |
| 2009/0040714 | A1 | 2/2009 | Yamada et al. | |
| 2009/0226299 | A1 | 9/2009 | Jin | |
| 2017/0051747 | A1 * | 2/2017 | Nakamura | F04D 25/06 |

FOREIGN PATENT DOCUMENTS

| | | | |
|---|---|---|---|
| JP | 2007-303432 | A | 11/2007 |
| JP | 4862482 | B2 | 1/2012 |
| JP | 5004022 | B2 | 8/2012 |

* cited by examiner

【Fig. 1】
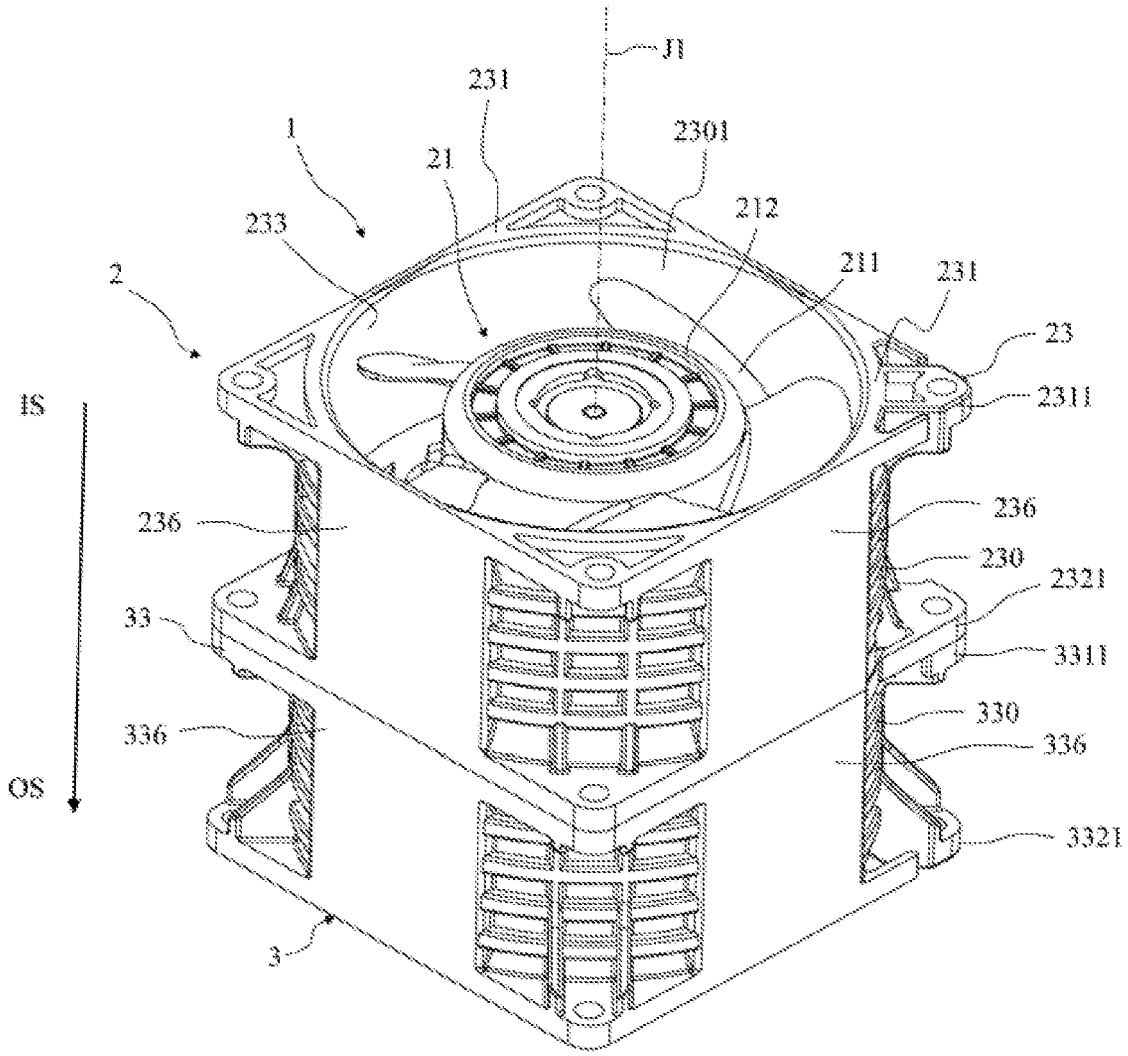

【Fig. 2】
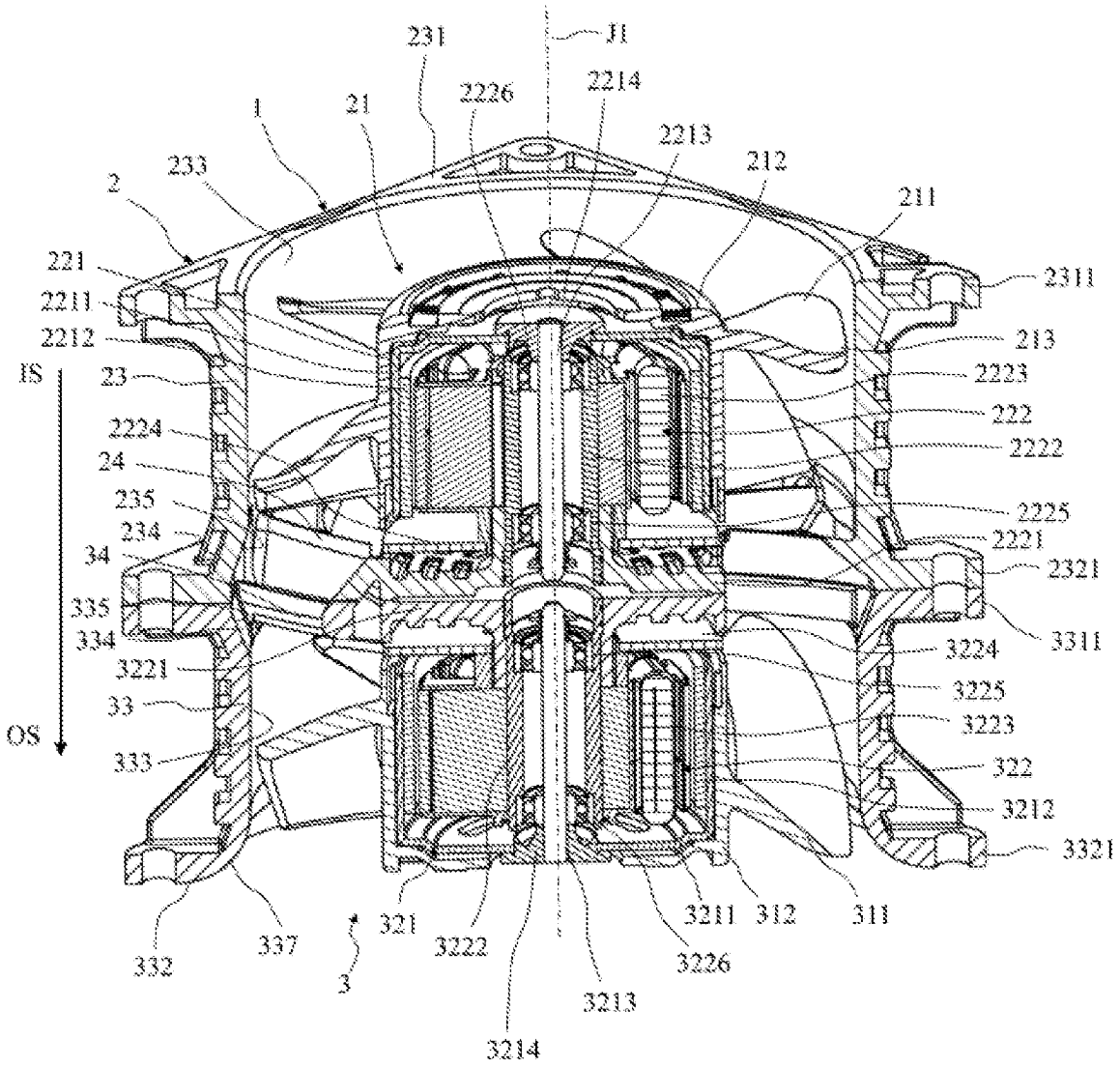

【Fig. 3】
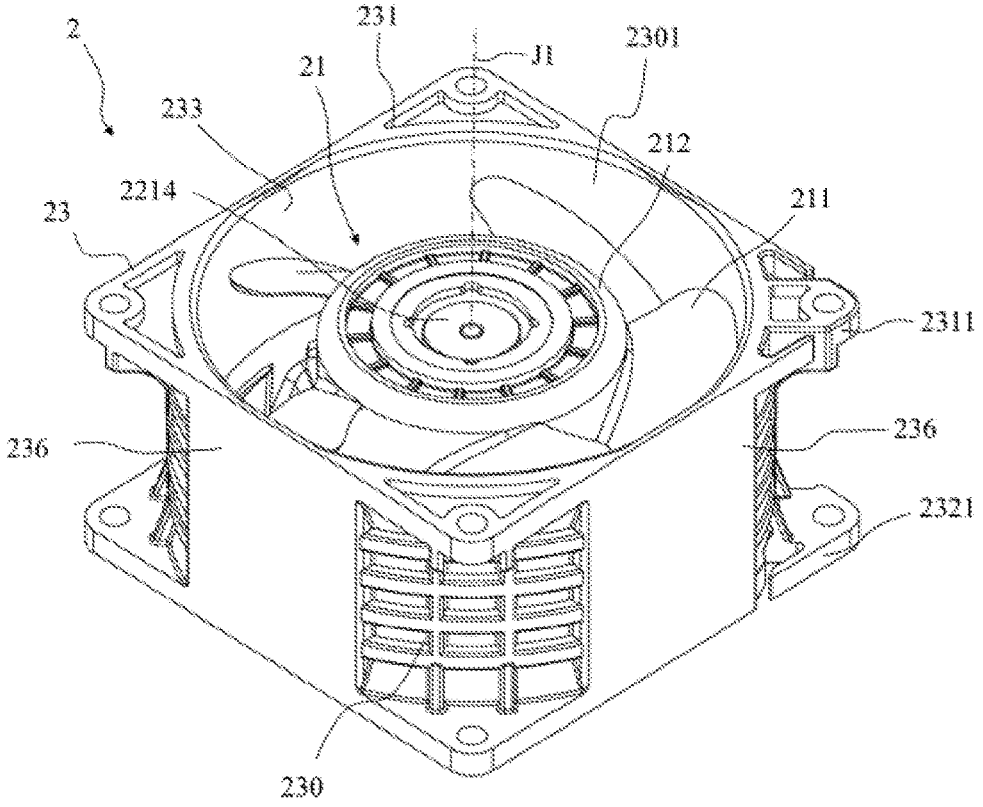
【Fig. 4】
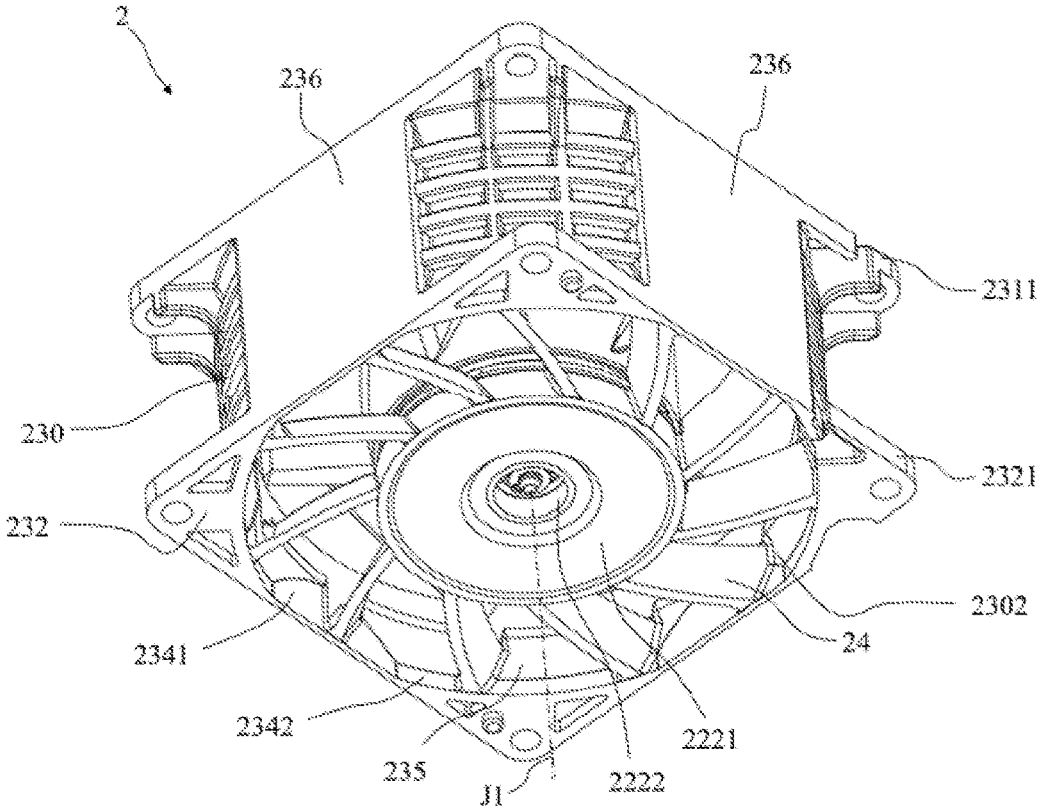

【Fig. 5】
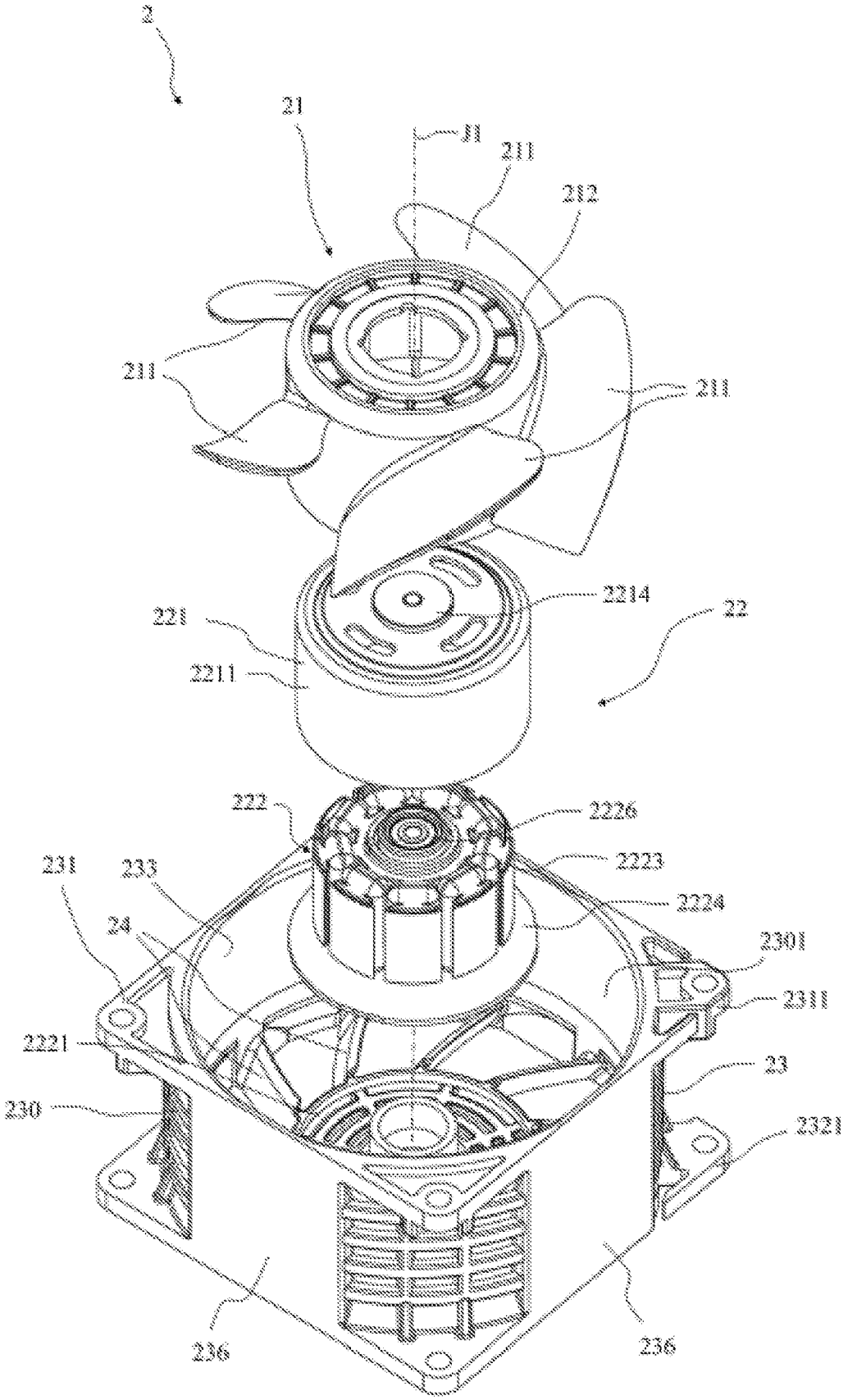

【Fig. 6】
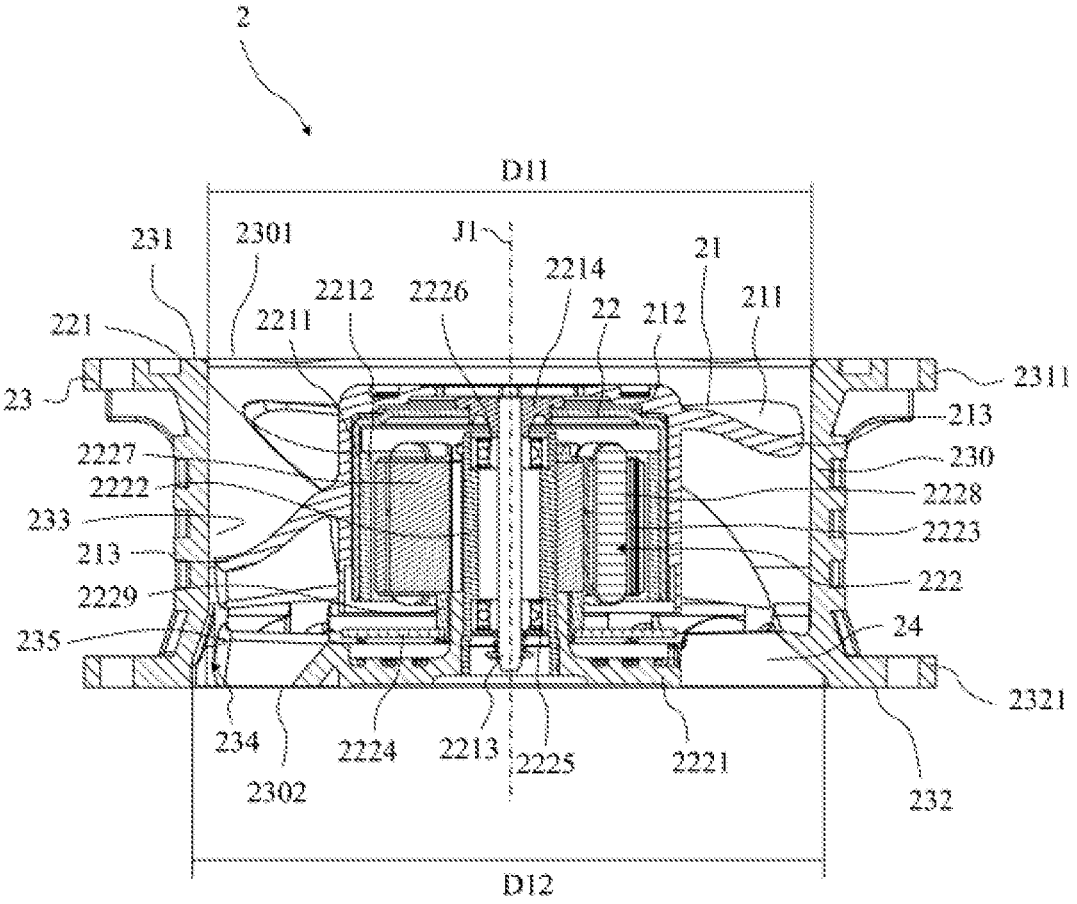

【Fig. 7】
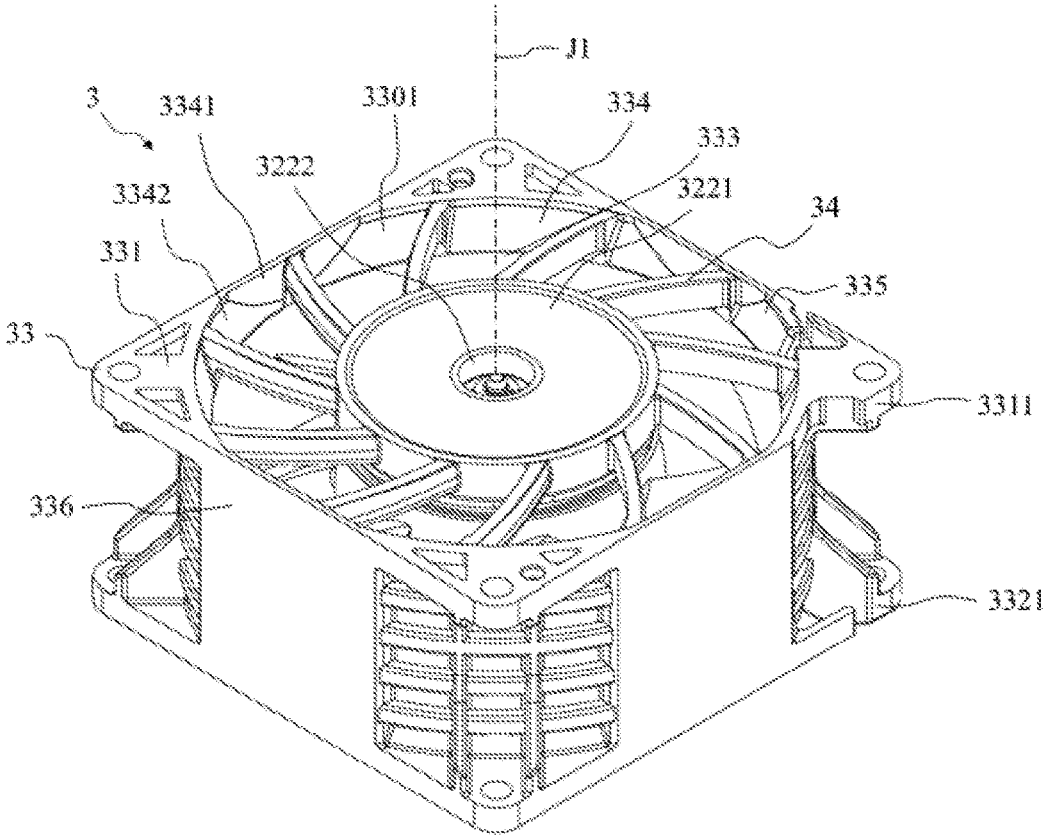
【Fig. 8】
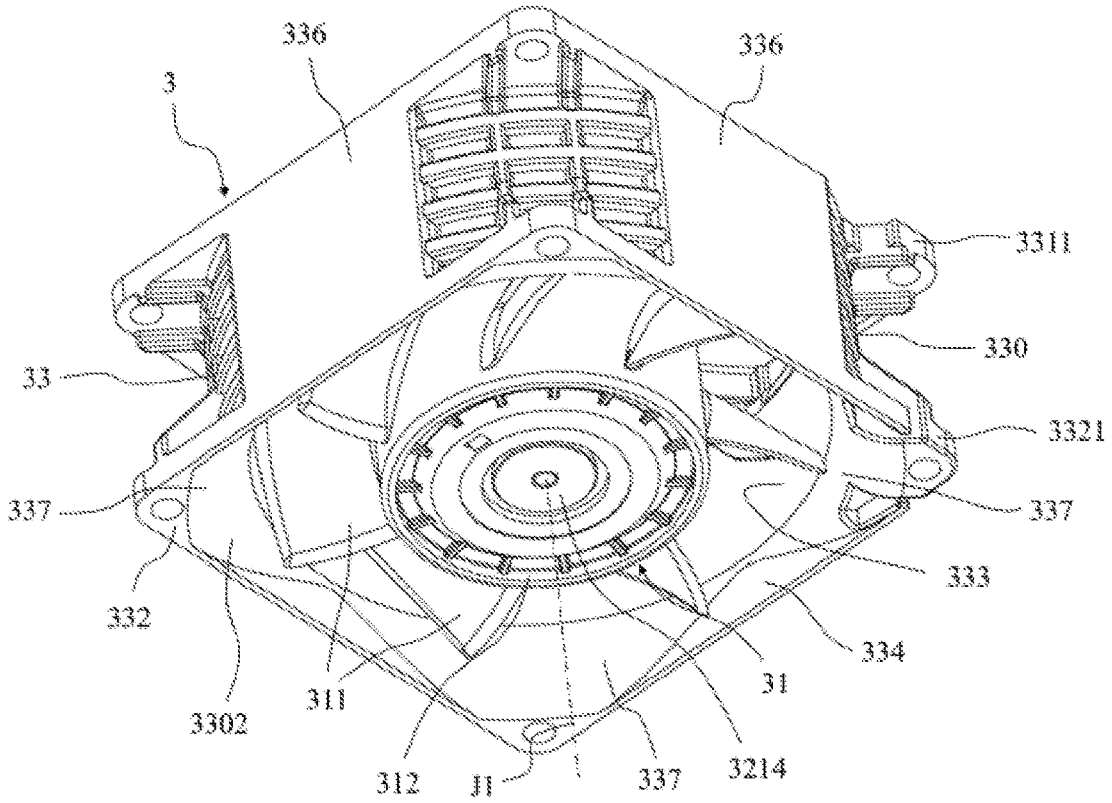

【Fig. 9】
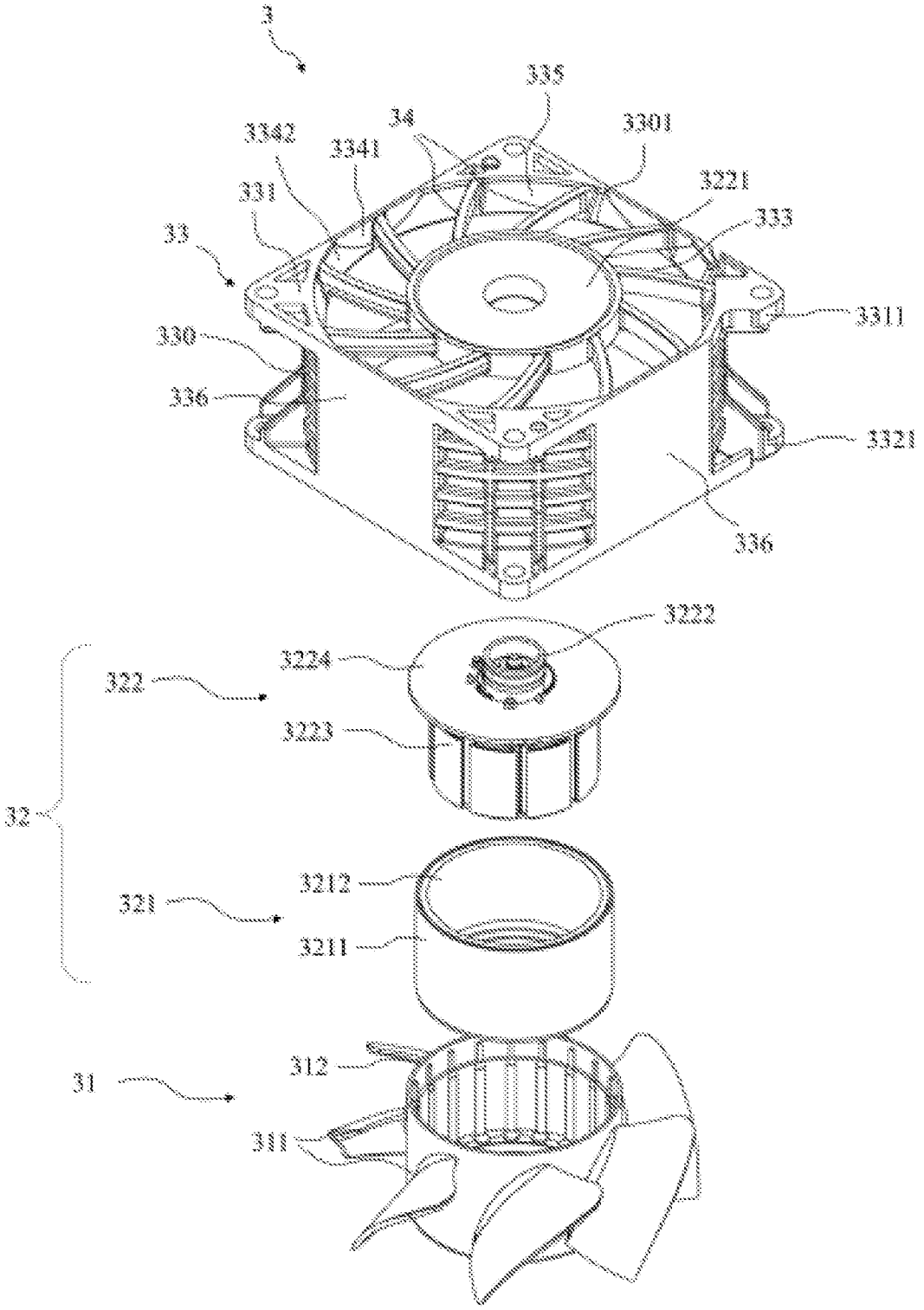

【Fig. 1 0】
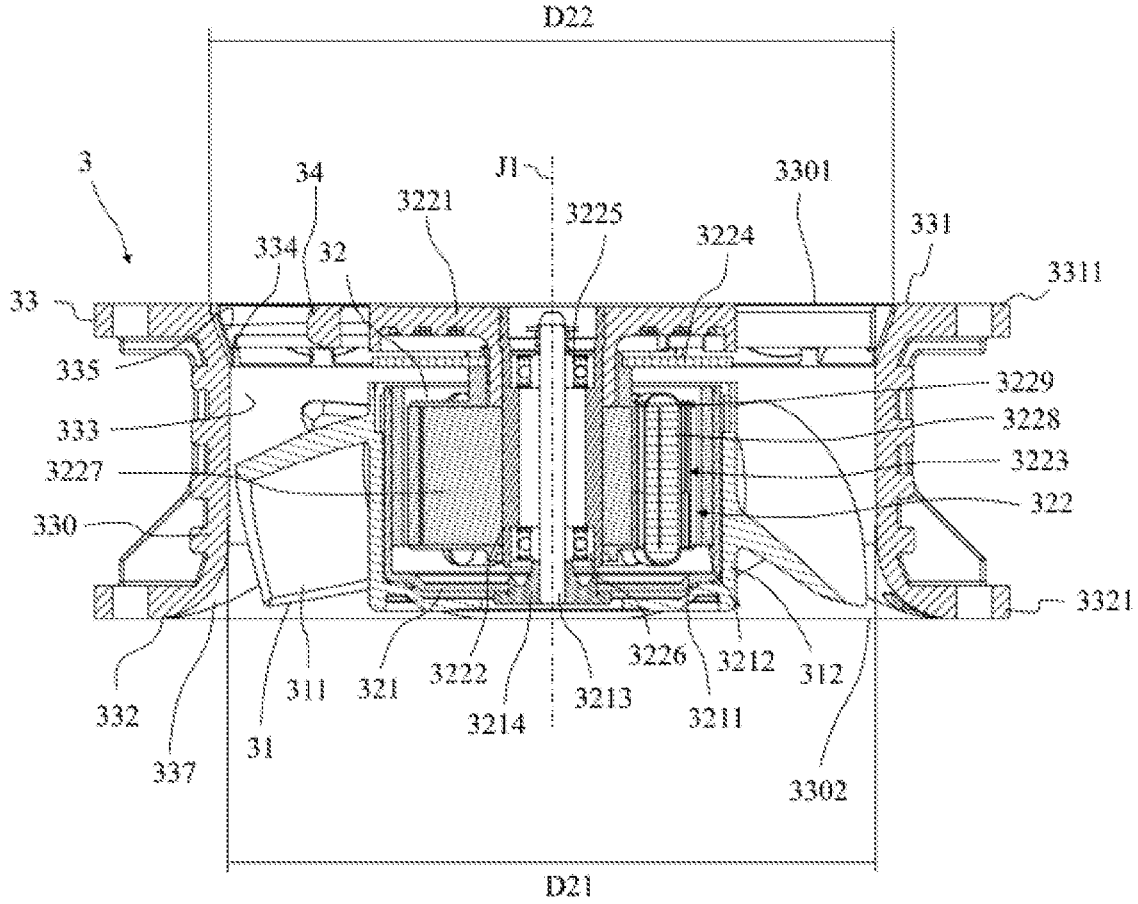

SERIAL AXIAL FLOW FAN

CROSS REFERENCE TO RELATED APPLICATIONS

This application claims the benefit of priority to U.S. Patent Application No. 62/445,355 filed on Jan. 12, 2017 and Japanese Patent Application No. 2018-000931 filed on Jan. 9, 2018. The entire contents of these applications are hereby incorporated herein by reference.

BACKGROUND OF THE INVENTION

1. Field of the Invention

The present disclosure relates to a serial axial flow fan in which axial flow fans are directly connected to each other.

2. Description of the Related Art

Hitherto, axial flow fans are used as cooling fans that cool electronic components disposed inside casings. Static pressure and air volume required in a cooling fan are on the rise due to an increase in heat generating amounts of electronic components caused by increase in performance, and due to an increase in the density where the electronic components are disposed caused by miniaturization of the casing. In order to increase the static pressure and the air volume of the cooling fan, serially disposed axial flow fans, such as the one described in Japanese Laid-open Patent Application Publication No. 2007-303432 in which two (a plurality of) axial flow fans are serially connected to each other in an axial direction, are proposed.

In recent years, the amount of heat generated by electronic components is increasing, and the density in which the electronic components are disposed inside a casing is getting higher. Furthermore, there are cases in which the air from the serially disposed axial flow fan does not easily spread inside the casing due to a formation of a portion where the gap between the components are small, and due to another electronic component being disposed behind an electronic component. The electronic components may become insufficiently cooled due to hindrance in the spreading of the airflow.

SUMMARY OF THE INVENTION

An object of the present disclosure is to provide a serial axial flow fan that is capable of improving the static pressure and the air volume with regards to the input shaft power, and that is capable of reducing noise.

An exemplification of a serial axial flow fan according to the present disclosure includes a first axial flow fan that blows out air drawn in from an intake side to an exhaust side, a second axial flow fan connected to the first axial flow fan along a central axis of the first axial flow fan, the second axial flow fan blowing out the air drawn in from an intake side to an exhaust side, wherein an end portion of the first axial flow fan on the exhaust side and an end portion of the second axial flow fan on the intake side are connected to each other, the first axial flow fan including a first impeller that rotates about the central axis, a first motor portion that rotates the first impeller, a first housing that includes a first cylindrical portion that surrounds an outside of the first impeller in a radial direction, and a first support rib that extends inwards from an inner surface of the first cylindrical portion and that supports the first motor portion, the first impeller including a plurality of first blades that extend outwards in the radial direction and that are arranged in a circumferential direction, the first axial flow fan including a second impeller that rotates about the central axis, a second motor portion that rotates the second impeller, a second housing that includes a second cylindrical portion that surrounds an outside of the second impeller in the radial direction, and a second support rib that extends inwards from an inner surface of the second cylindrical portion and that supports the second motor portion, and the second impeller including a plurality of second blades that extend outwards in the radial direction and that are arranged in the circumferential direction. In the serial axial flow fan, at least either of the first blades and the second blades are provided with auxiliary blade portions.

The exemplification of the serial axial flow fan of the present disclosure is capable of improving static pressure and air volume with regards to the input shaft power, and is capable of reducing noise.

The above and other elements, features, steps, characteristics and advantages of the present discloser will become more apparent from the following detailed description of the preferred embodiments with reference to the attached drawings.

BRIEF DESCRIPTION OF THE DRAWINGS

FIG. 1 is a perspective view of an example of a serial axial flow fan according to the present disclosure.

FIG. 2 is a cross-sectional view of the serial axial flow fan illustrated in FIG. 1 cut along a plane including a central axis.

FIG. 3 is a perspective view of a first axial flow fan viewed from above.

FIG. 4 is a perspective view of the first axial flow fan viewed from below.

FIG. 5 is an exploded perspective view of the first axial flow fan illustrated in FIG. 3.

FIG. 6 is a cross-sectional view of the first axial flow fan illustrated in FIG. 3 cut along a plane including the central axis.

FIG. 7 is a perspective view of a second axial flow fan viewed from above.

FIG. 8 is a perspective view of the second axial flow fan viewed from below.

FIG. 9 is an exploded perspective view of the second axial flow fan illustrated in FIG. 7.

FIG. 10 is a cross-sectional view of the second axial flow fan illustrated in FIG. 7 cut along a plane including the central axis.

DETAILED DESCRIPTION OF THE PREFERRED EMBODIMENTS

Hereinafter, exemplary embodiments of the present disclosure will be described in detail with reference to the drawings. Note that in the present specification, in a serial axial flow fan 1, a direction parallel to a central axis J1 of the serial axial flow fan 1 is referred to as an "axial direction", a direction orthogonal to the central axis J1 of the serial axial flow fan 1 is referred to as a "radial direction", and a direction extending along an arc about a center of the central axis J1 of the serial axial flow fan 1 is referred to as a "circumferential direction". Furthermore, in the serial axial flow fan 1, the axial direction is referred to as an up-down direction, and an upper side IS and a lower side OS are defined with the state illustrated in FIG. 1 as a reference.

Note that the up-down direction is a term used for description and does not limit the positional relationship and the direction of the serial axial flow fan 1 while in use.

A serial axial flow fan of an exemplary embodiment of the present disclosure will be described hereinafter. FIG. 1 is a perspective view of an example of a serial axial flow fan according to the present disclosure. FIG. 2 is a cross-sectional view of the serial axial flow fan illustrated in FIG. 1 cut along a plane including the central axis. The serial axial flow fan 1 illustrated in FIGS. 1 and 2 draws in air through an end portion on the upper side IS. Furthermore, the air that has been drawn in is compressed and (or) accelerated inside the serial axial flow fan 1 and is discharged from an end portion on the lower side OS. Note that in the description hereinafter, the upper side may be referred to as an intake side, and the lower side may be referred to as an exhaust side.

As illustrated in FIGS. 1 and 2, the serial axial flow fan 1 includes a first axial flow fan 2 and a second axial flow fan 3. The first axial flow fan 2 is disposed on the upper side of the second axial flow fan 3. In other words, the first axial flow fan 2 is disposed on the intake side of the second axial flow fan 3. Furthermore, in the serial axial flow fan 1, the first axial flow fan 2 and the second axial flow fan 3 are connected in series along the central axis J1. In other words, centers of the first axial flow fan 2 and the second axial flow fan 3 coincides with the central axis J1.

The upper sides IS of the first axial flow fan 2 and the second axial flow fan 3 are both the intake sides, and the lower sides OS thereof are the exhaust sides. Furthermore, the exhaust side of the first axial flow fan 2 and the intake side of the second axial flow fan 3 are connected to each other. In other words, the air discharged through a first exhaust portion 2302 described later provided at an end face of the first axial flow fan 2 on the lower side OS is drawn in through a second intake portion 3301 described later provided at an end face of the second axial flow fan 3 on the upper side IS.

In other words, the first axial flow fan 2 blows the air drawn in from the intake side out from the exhaust side. Furthermore, the second axial flow fan 3 connected to the first axial flow fan 2 along the central axis J1 of the first axial flow fan 2 blows the air drawn in from the intake side out from the exhaust side. Furthermore, in the serial axial flow fan 1, the end portion of the first axial flow fan 2 on the exhaust side is connected to the end portion of the second axial flow fan 3 on the intake side.

FIG. 3 is a perspective view of the first axial flow fan viewed from above. FIG. 4 is a perspective view of the first axial flow fan viewed from below. FIG. 5 is an exploded perspective view of the first axial flow fan illustrated in FIG. 3. FIG. 6 is a cross-sectional view of the first axial flow fan illustrated in FIG. 3 cut along a plane including the central axis. As illustrated in FIGS. 3 to 6, the first axial flow fan 2 includes a first impeller 21, a first motor portion 22, a first housing 23, and a plurality of first support ribs 24.

The first housing 23 is an outer package of the first axial flow fan 2, and protects the first impeller 21, the first motor portion 22, and other components.

The first housing 23 includes a first cylindrical portion 230, a first intake flange portion 2311, and a first exhaust flange portion 2321. The first cylindrical portion 230 is a cylinder penetrating from an upper end portion 231 to a lower end portion 232 along the central axis J1. The upper end portion 231 of the first cylindrical portion 230 is a first intake portion 2301, and the lower end portion 232 is the first exhaust portion 2302. As illustrated in FIGS. 3 to 6, the first cylindrical portion 230 includes four outer flat surfaces 236 each having a shape formed when the outer peripheral surface of the circular cylinder is cut by a plane parallel to the central axis J1. The outer flat surfaces 236 are disposed at equal intervals in the circumferential direction. The outer flat surfaces 236 are surfaces that are parallel to the central axis J1.

In the first axial flow fan 2, the first impeller 21 rotates inside first cylindrical portion 230 about the central axis J1, and generates an airflow. In other words, while the first cylindrical portion 230 is a portion of the outer package, the first cylindrical portion 230 is also a wind tunnel. In other words, the first housing 23 includes the first cylindrical portion 230 that surrounds the other side of the first impeller 21 in the radial direction. Furthermore, the first impeller 21 rotates about the central axis J1.

The first intake flange portion 2311 is provided at the upper end portion 231 of the first housing 23. The first intake flange portion 2311 has a square shape when viewed in a central axis J1 direction and a length of each side is longer than an inside diameter of the first cylindrical portion 230. Corner portions of the first intake flange portion 2311 when viewed in the central axis J1 direction expand from the outer peripheral surface of the first cylindrical portion 230 towards the outside in the radial direction. Note that the corner portions are portions that include the corners of the square, and are portions that include the areas having a predetermined width in the circumferential direction that include the corners. Corner portions described hereinafter will be similar to the above corner portions. Furthermore, the surfaces that constitute the sides of the square first intake flange portion 2311 when viewed in the central axis J1 direction are each flush with the corresponding outer flat surface 236.

The first exhaust flange portion 2321 is provided at the lower end portion 232 of the first housing 23. The first exhaust flange portion 2321 has a square shape when viewed in the central axis J1 direction and a length of each side is longer than the inside diameter of the first cylindrical portion 230. Corner portions of the first exhaust flange portion 2321 when viewed in the central axis J1 direction expand from the outer peripheral surface of the first cylindrical portion 230 towards the outside in the radial direction. Furthermore, the surfaces that constitute the sides of the first exhaust flange portion 2321 when viewed in the central axis J1 direction are each flush with the corresponding outer flat surface 236. Moreover, when viewed in the central axis J1 direction, the first intake flange portion 2311 and the first exhaust flange portion 2321 overlap each other.

The first cylindrical portion 230 includes a first inside diameter portion 233 and a second inside diameter portion 234. The first inside diameter portion 233 is disposed on the intake side with respect to the second inside diameter portion 234, in other words, the first inside diameter portion 233 is disposed on the upper side IS. The first inside diameter portion 233 is tubular, and an inside diameter D11 thereof does not change in the axial direction. The minimum inside diameter of the first cylindrical portion 230 is the inside diameter D11. In other words, the first inside diameter portion 233 is a minimum inside diameter portion. In the first cylindrical portion 230, the second inside diameter portion 234 is disposed on the lower end portion 232 side, in other words, the second inside diameter portion 234 is disposed at the end portion on the exhaust side. The second inside diameter portion 234 includes a portion that has a diameter that is larger than that of the first inside diameter portion 233. The portions of the second inside diameter portion 234 that overlap the outer flat surfaces 236 in the radial direction are inner flat surfaces 2341, and portions that connect the inner flat surfaces 2341 to each other in the circumferential direction are inner curved surfaces 2342. The section of the lowermost side of each inner curved surface 2342 of the second inside diameter portion cut along a plane orthogonal to the central axis has an arc shape and an inside diameter thereof is an inside diameter D12. Furthermore, the inside diameter D11 of the first inside diameter portion 233 is smaller than the inside diameter D12 of each inner curved surface 2342 of the second inside diameter portion 234.

The inner curved surfaces 2342 include conical portions 235. Each conical portion 235 is a portion of a conical inner surface and the diameter of each conical portion 235 widens towards the lower side, in other words, the exhaust side.

The first axial flow fan 2 includes 11 first support ribs 24. The 11 first support ribs 24 extend from the second inside diameter portion 234 towards the inner side in the radial direction, and are disposed at equal intervals in the circumferential direction. Inner sides of the first support ribs 24 in the radial direction are connected to a base portion 2221 (described later) of the first motor portion 22. With the above, the first motor portion 22 is supported by the first housing 23 with the first support ribs 24. The first housing 23, the first support ribs 24, and the base portion 2221 are formed as a resin molded body formed in an integrated manner with resin. In the first axial flow fan 2, the first support ribs 24 are disposed on the lower end side of the first housing 23. In other words, the first support ribs 24 extend from an inner circumferential surface of the first cylindrical portion 230 towards the inner side, and support the first motor portion 22.

When viewed in the central axis J1 direction, the first support ribs 24 are disposed inside the first cylindrical portion 230. Furthermore, each first support ribs 24 traverses at least a portion of the airflow generated inside the first cylindrical portion 230 with the rotation of the first impeller 21. The airflow generated by the rotation of the first impeller 21 has a velocity component in the axial direction and has a velocity component in the direction in which the first impeller 21 rotates, in other words, in the circumferential direction. Accordingly, the first support ribs 24 each have an inclination that does not cause the airflow to flow back due to the velocity component of the airflow in the circumferential direction, in other words, the first support ribs 24 each have an inclination in which the lower side is positioned on the downstream side in the rotation direction with respect to the upper side IS. Although the details will be described later, when the first axial flow fan 2 and the second axial flow fan 3 are connected to each other, the first support ribs 24 and second support ribs 34 constitute stator blades, and regulates the airflow in the axial direction. In other words, the first support ribs 24 support the first motor portion 22 and, at the same time, serve as stator blades that regulate the airflow. The first motor portion 22 is of a so-called outer rotor type. As illustrated in FIG. 6, the first motor portion 22 includes a first rotor portion 221 and a first stator portion 222. The first motor portion 22 rotates the first impeller 21.

The first stator portion 222 includes the base portion 2221, a bearing holding portion 2222, an armature 2223, and a circuit board 2224. The base portion 2221 is formed as an integrally molded body together with the first housing 23 and the first support ribs 24. The base portion 2221 has a disk shape orthogonal to the central axis J1. The center of the disk shape overlaps the central axis J1. The bearing holding portion 2222 has a cylindrical shape, is disposed at a center portion of the base portion 2221, and extends towards the upper side IS. Note that the bearing holding portion 2222 may be an integrally molded body molded together with the base portion 2221. A ball bearing 2225 and a ball bearing 2226 are attached to an upper portion and a lower portion inside the bearing holding portion 2222. Furthermore, a shaft 2213 (described later) of the first rotor portion 221 is rotatably supported through the ball bearing 2225 and the ball bearing 2226. Note that the ball bearing 2225 and the ball bearing 2226 are examples of a bearing mechanism, and the bearing mechanism is not limited to the ball bearing 2225 and the ball bearing 2226. Bearings that are structured to rotatably support the shaft 2213 may be widely employed.

The armature 2223 is fixed external to the bearing holding portion 2222 in the radial direction. The armature 2223 includes a stator core 2227, a coil 2228, and an insulator 2229. The stator core 2227 is a stacked body in which electromagnetic steel sheets are stacked in the axial direction. Note that the stator core 2227 is not limited to a stacked body in which electromagnetic steel sheets are stacked, and may be a single member, such as a fired body of powder or a casting, for example. The stator core 2227 includes an annular core back and a plurality of (nine, herein) teeth. The nine teeth extend towards the outside in the radial direction from an outer peripheral surface of the core back and are formed radially. With the above, the nine teeth are arranged in the circumferential direction. The coil 2228 is configured by winding a length of conducting wire around the teeth on which the insulator 2229 has been attached.

The core back of the stator core 2227 is press-fitted in the bearing holding portion 2222, and the stator core 2227 is fixed to the bearing portion 2222. The press-fitting may be a so-called stationary fit, or may be a light press-fit that is a so-called transition fit in which the press-fitting force is weaker than the press-fitting. The core back and the bearing holding portion 2222 may be fixed to each other by another method, such as adhesion. When the stator core 2227 is fixed to the bearing holding portion 2222, the center thereof overlaps the central axis J1. Furthermore, the nine teeth of the stator core 2227 are arranged at equal intervals in the circumferential direction to smoothly and efficiently rotate the first motor portion 22.

The circuit board 2224 is attached to the base portion 2221. The circuit board 2224 is electrically connected to the coil 2228 of the first stator portion 222. The circuit board 2224 includes a drive circuit that drives the coil 2228.

The base portion 2221 of the first stator portion 222 is an integrally molded body formed together with the first support ribs 24. With the above, the first stator portion 222, in other words, the first motor portion 22 is supported by the first support ribs 24. Furthermore, the first support ribs 24 are also an integrally molded body formed together with the first housing 23. Accordingly, the first motor portion 22 is connected to the first housing 23 through the first support ribs 24, in other words, the first motor portion 22 is supported by the first housing 23.

The first rotor portion 221 includes a yoke 2211, a field magnet 2212, the shaft 2213, and a shaft fixing member 2214. The yoke 2211 is made of metal and has a lidded cylindrical shape about the central axis J1. The shaft fixing member 2214 is fixed to the center of the lid-shaped portion of the yoke 2211. The shaft 2213 is fixed to the shaft fixing member 2214 with a fixing method, such as press-fitting. Note that the fixing method is not limited to press-fitting and may be another method, such as adhesion. In other words, the yoke 2211 is fixed to the shaft 2213 through the shaft fixing member 2214.

The field magnet 2212 has a circular cylinder shape. The field magnet 2212 is fixed to an inner surface of the yoke 2211. The field magnet 2212 is magnetized to the N-pole and the S-pole alternately in the circumferential direction. Note that in place of the field magnet 2212 having a circular cylinder shape, a plurality of field magnets may be arranged in the circumferential direction.

The shaft 2213 is made of metal and has a columnar shape. The shaft 2213 is rotatably supported by the bearing holding portion 2222, in other words, by the first stator portion 222 through the ball bearing 2225 and the ball bearing 2226. The center of the shaft 2213 rotatably supported by the bearing holding portion 2222 overlaps the central axis J1.

In the first motor portion 22, by having the shaft 2213 be rotatably supported through the ball bearing 2225 and the ball bearing 2226, the first rotor portion 221 is supported by the first stator portion 222 in a rotatable manner about the central axis J1. In the above, an inner surface of the field magnet 2212 of the first rotor portion 221 in the radial direction and an outer surface of the stator core 2227 in the radial direction oppose each other with a gap therebetween in the radial direction. An operation of the first motor portion 22 will be described in detail later.

As illustrated in FIGS. 5 and 6, the first impeller 21 includes a plurality of first blades 211, a cup 212, and auxiliary blade portions 213. The cup 212 has a lidded cylindrical shape. Note that while the cup 212 has a lidded cylindrical shape, the shape is not limited to the above, and may be a truncated cone shape in which the outside diameters of an outer peripheral surface differ in the axial direction.

The first blades 211 each protrude from the outer surface of the cup 212 in the radial direction towards the outside in the radial direction. The first impeller 21 is provided with five first blades 211. The five first blades 211 are aligned at equal intervals in the circumferential direction. In other words, the first impeller 21 includes the plurality of first blades 211 that extend outwards in the radial direction and that are arranged in the circumferential direction. The first blades 211 are inclined in the circumferential direction and generate an airflow from the upper side towards the lower side when the first impeller 21 is rotated. In other words, the first blades 211 are each inclined to a direction that generates an airflow from the upper side IS towards the lower side. Surfaces of the first blades 211 on the exhaust side, in other words, the surfaces on the lower side are the pressure surfaces. Furthermore, surfaces of the first blades 211 on the intake side, in other words, the surfaces on the upper side IS are negative pressure surfaces.

Furthermore, the auxiliary blade portions 213 are provided at outer edge portions of the first blades 211 in the radial direction. With the above configuration, a vortex can be generated by the auxiliary blade portions 213 and the backflow of air in the gaps between outer edge portions of the auxiliary blade portions 213 in the radial direction and an inner surface of the first cylindrical portion 230 can be suppressed. Details will be described later. The auxiliary blade portions 213 are each formed in the entire area of the outer edge portion of the corresponding first blade 211 from a front end in the rotation direction to a rear end in the rotation direction. By configuring the auxiliary blade portions 213 in the above manner, the pressure in the entire outer edge portions of the first blades 211 can be increased with the auxiliary blade portions 213. With the above, a pressure increasing effect can be obtained. Furthermore, there are cases in which the manufacturing is easier compared with a case in which the auxiliary blade portion 213 is formed in a portion of the outer edge portion. Moreover, the auxiliary blade portions 213 are each warped towards the outside in the radial direction and to the upper side in the axial direction, in other words, to the intake side. With the above configuration, the pressure generated with each auxiliary blade portion can be increased with the auxiliary blade portion with a simple shape. Furthermore, manufacturing is easier compared to a configuration in which the auxiliary blade portions are attached in an additional manner.

In the first axial flow fan 2, an inflow of air in the outer edge portions of the first blades 211 in the radial direction from the pressure surface side towards the negative pressure surface side is suppressed with the auxiliary blade portions 213. Note that an operation of suppressing the flow of air will be described in detail later.

As described above, the first stator portion 222 of the first motor portion 22 is assembled by attaching the bearing holding portion 2222, the armature 2223, and the circuit board 2224 to the base portion 2221 formed integrally with the first housing 23. In other words, the first stator portion 222 is supported by the first housing 23 through the first support ribs 24.

Furthermore, the yoke 2211 of the first rotor portion 221 is fixed inside the cup 212 of the first impeller 21. The yoke 2211 may be fixed in the cup 212 by press-fitting or by adhesion. Furthermore, the yoke 2211 may be fixed with a fastening member, such as a screw. The cup 212 suppressing deviation from the yoke 2211 is fixed to the yoke 2211. In other words, the first impeller 21 is fixed to the first rotor portion 221.

Furthermore, the shaft 2213 of the first rotor portion 221 to which the first impeller 21 is fixed is fixed to the inner rings of the ball bearing 2225 and the ball bearing 2226 attached inside the bearing holding portion 2222. Note that while the shaft 2213 is fixed to the inner rings of the ball bearing 2225 and the ball bearing 2226 by press-fitting, the fixing method is not limited to press-fitting. For example, a fixing method, such as adhesion or welding, that suppresses the relative movement between the shaft 2213 and the inner rings, and that fixes the shaft 2213 about the central axis J1 in a rotatable manner can be widely employed. The first rotor portion 221 to which the first impeller 21 is attached is rotatably attached to the first stator portion 222 in the above manner.

By attaching the first rotor portion 221 to the first stator portion 222, the first impeller 21 is accommodated inside the first housing 23. The outer sides of the auxiliary blade portions 213 in the radial direction, the auxiliary blade portions 213 being provided at the outer edge portions of the first blades 211 in the radial direction, oppose the inner surface of the first cylindrical portion 230 in the radial direction.

An electric current is supplied to the coil 2228 of the first motor portion 22 at a good timing from the drive circuit mounted on the circuit board 2224. With the above, the first rotor portion 221 of the first motor portion 22 is rotated in a predetermined direction. Note that, herein, the rotation direction of the first rotor portion 221 is anticlockwise when viewing the central axis J1 from the upper side IS.

By rotating the first motor portion 22 about the central axis J1, the first impeller 21 fixed to the first rotor portion 221 is also rotated about the central axis J1. With the rotation of the first impeller 21, an airflow that, while swirling in the circumferential direction, flows in the axial direction is generated in the first housing 23, in other words, inside the first cylindrical portion 230.

With the rotation of the first impeller 21, the first blades 211 push the air. Accordingly, the surfaces on the lower side (the surfaces on the exhaust side) of the first blades 211 are pressure surfaces, and the surfaces on the upper side IS (the surfaces on the intake side) are negative pressure surfaces. The first impeller 21 has five first blades 211, and the inclination of each first blade 211 with respect to the central axis J1 is large. Accordingly, a pressure difference between each pressure surface and the corresponding negative pressure surface is large. In the first axial flow fan 2, the outer edge portions of the first blades 211 in the radial direction and the inner surface of the first cylindrical portion 230 oppose each other in the radial direction with a gap in between. Accordingly, when the first impeller 21 is rotated and a pressure difference is generated in the first blades between the pressure surfaces and the negative pressure surfaces, a flow of air from the pressure surface side towards the negative pressure surface side, in other words, from the lower side OS towards the upper side IS, is easily generated in the outer edge portions of the first blades 211 in the radial direction.

The auxiliary blade portions 213 are provided at the outer edge portions of the first blades 211 in the radial direction. The auxiliary blade portions 213 are warped towards the upper side IS (the intake side). When the first impeller 21 is rotated, the auxiliary blade portions 213 generate a vortex in the gap between the outer edge portions of the auxiliary blade portions 213 in the radial direction and the inner surface of the first cylindrical portion 230. With the above vortex, a flow of air on the lower side towards the upper side in the gap between the outer edge portions of the auxiliary blade portions 213 and the inner surface of the first cylindrical portion 230 can be suppressed. Accordingly, by suppressing the flow of air from the lower side towards the upper side, a decrease in the pressure difference between the pressure surfaces and the negative pressure surfaces is suppressed, in other words, pressure loss is suppressed. As a result, the first axial flow fan 2 is capable of discharging an airflow with high pressure through the first exhaust portion 2302. A vortex is formed in the gap between the inner surface of the first cylindrical portion 230 and the outer edge portions of the auxiliary blade portions 213 in the radial direction, and backflow of air in the gap is suppressed by the vortex. In order to have the vortex effectively suppress the backflow of air in the gap between the inner surface of the first cylindrical portion 230 and the outer edge portions of the auxiliary blade portions 213 in the radial direction, the gap between the inner surface of the first cylindrical portion 230 and the outer edge portions of the auxiliary blade portions 213 in the radial direction is desirably as narrow as possible. Furthermore, the gap between the inner surface of the first cylindrical portion 230 and the outer edge portions of the auxiliary blade portions 213 in the radial direction is desirably uniform. Note that the gap between the inner surface of the first cylindrical portion 230 and the outer side of the auxiliary blade portions 213 in the radial direction being uniform not only includes a case in which the gap is uniform in an accurate manner, but also may include a case in which the gap has variations that do not affect the operation of the first axial flow fan 2. With such a configuration, the gap can be prevented from becoming partially large. With the above, partial change in the gap is suppressed and the pressure balance is maintained; accordingly, the first impeller 21 can rotate smoothly, and vibration, noise, and the like are suppressed. In other words, noise of the serial axial flow fan 1 can be reduced.

By making the gap between the inner surface of the first cylindrical portion 230 and the outer edge portions of the auxiliary blade portions 213 in the radial direction uniform, the variation in the effect of suppressing the backflow with the vortex is suppressed. With the above, the pressure balance in the circumferential direction of the first impeller 21 is not easily lost. As a result, the first impeller 21 can be rotated smoothly, and vibration and (or) noise can be suppressed. In other words, noise of the serial axial flow fan 1 can be reduced.

The auxiliary blade portions 213 are contained inside the length of the first cylindrical portion 230 in the axial direction. Since the auxiliary blade portions 213 reliably oppose the first cylindrical portion 230, the pressure increasing effect can be increased. Furthermore, by containing the auxiliary blade portions 213 inside the circular cylinder, the shape of each auxiliary blade portion 213 forming the gap with the inner surface of the first cylindrical portion 230 in the radial direction at an equal distance can be simplified. The ease of manufacturing the first impeller 21 is facilitated more, accordingly. Furthermore, by having the surfaces opposing the auxiliary blade portions 213 in the radial direction be a circular cylinder, the changes in the outside diameters of the auxiliary blade portions 213 becomes small, and the changes in the pressure and the flow velocity can be suppressed. With the above, the effect of increasing the pressure of the discharged airflow can be increased.

In the first axial flow fan 2, desirably, the outer edges of the auxiliary blade portions 213 in the radial direction oppose the inner surface of the first inside diameter portion 233 of the first cylindrical portion 230 in the radial direction. In other words, in the inner surface of the first cylindrical portion 230, at least the portion that opposes the auxiliary blade portions 213 in the radial direction is, desirably, a circular cylinder. Since the change in the inside diameter of the portion of the first cylindrical portion 230 that opposes the auxiliary blade portions 213 is small, the pressure and the flow velocity do not easily change and the pressure can be increased.

Note that the auxiliary blade portions 213 may oppose the second inside diameter portion 234 in the radial direction. In such a case as well, the shapes of the outer edges of the auxiliary blade portions 213 are shapes in which the gap between the outer edges of the auxiliary blade portions 213 in the radial direction and the inner surface of the second inside diameter portion 234, and the gap between the outer edges of the auxiliary blade portions 213 in the radial direction and the inner surface of the first inside diameter portion 233 are the same. With the above configuration, the above-described effect of suppressing vibration and (or) noise can be obtained. In other words, noise of the serial axial flow fan 1 can be reduced.

Note that in the first impeller 21, the auxiliary blade portions 213 are each formed in the entire area of the outer edge portion of the corresponding first blade 211 in the radial direction from a front end in the rotation direction to a rear end in the rotation direction. With the above, the pressure loss is reduced, and the pressure of the airflow discharged through the first exhaust portion 2302 is increased. Meanwhile, there are cases in which the pressure of the airflow discharged through the first exhaust portion 2302 is required to be only of a certain amount. In such a case, the auxiliary blade portions 213 may be formed in a partial manner in the outer edge portions of the first blades 211 in the radial direction from the front end in the rotation direction to the rear end in the rotation direction. With the above configuration, the pressure of the airflow discharged from the first exhaust portion 2302 can be adjusted. Note that the portions in which the auxiliary blade portions 213 are formed are, desirably, formed at the same portions in the plurality of first blades 211. With such a configuration, the distribution of pressure in each first blade 211 with the corresponding auxiliary blade portion 213 can be the same or substantially the same, and the pressure acting on the first impeller 21 can be balanced. With the above, vibrate and (or) noise can be suppressed.

In other words, noise of the serial axial flow fan 1 can be reduced.

FIG. 7 is a perspective view of the second axial flow fan viewed from above. FIG. 8 is a perspective view of the second axial flow fan viewed from below. FIG. 9 is an exploded perspective view of the second axial flow fan illustrated in FIG. 7. FIG. 10 is a cross-sectional view of the second axial flow fan illustrated in FIG. 7 cut along a plane including the central axis. As illustrated in FIGS. 7 to 10, the second axial flow fan 3 includes a second impeller 31, a second motor portion 32, a second housing 33, and the plurality of second support ribs 34.

The second housing 33 is an outer package of the second axial flow fan 3 and the serial axial flow fan 1, and protects the second impeller 31, the second motor portion 32, and other components.

The second housing 33 includes the second cylindrical portion 330, a second intake flange portion 3311, and a second exhaust flange portion 3321. The second cylindrical portion 330 is a cylinder penetrating from an upper end portion 331 to a lower end portion 332 along the central axis J1. The upper end portion 331 of the second cylindrical portion 330 is a second intake portion 3301, and the lower end portion 332 is a second exhaust portion 3302. As illustrated in FIGS. 7 to 9, the second cylindrical portion 330 includes four outer flat surfaces 336 each having a shape formed when the outer peripheral surface of the circular cylinder is cut by a plane parallel to the central axis J1. The outer flat surfaces 336 are disposed at equal intervals in the circumferential direction. The outer flat surfaces 336 are surfaces that are parallel to the central axis J1.

In the second axial flow fan 3, the second impeller 31 rotates inside second cylindrical portion 330 about the central axis J1, and generates an airflow. In other words, while the second cylindrical portion 330 is a portion of the outer package, the second cylindrical portion 330 is also a wind tunnel. In other words, the second housing 33 includes the second cylindrical portion 330 that surrounds the other side of the second impeller 31 in the radial direction. Furthermore, the second impeller 31 rotates about the central axis J1.

The second intake flange portion 3311 is provided at the upper end portion 331 of the second housing 33. The second intake flange portion 3311 has a square shape when viewed in a central axis J1 direction and a length of each side is longer than an inside diameter of the second cylindrical portion 330. Corner portions of the second intake flange portion 3311 when viewed in the central axis J1 direction expand from the outer peripheral surface of the second cylindrical portion 330 towards the outside in the radial direction. Furthermore, the surfaces that constitute the sides of the square second intake flange portion 3311 when viewed in the central axis J1 direction are each flush with the corresponding outer flat surface 336.

The second exhaust flange portion 3321 is provided at the lower end portion 332 of the second housing 33. The second exhaust flange portion 3321 has a square shape when viewed in the central axis J1 direction and a length of each side is longer than the inside diameter of the second cylindrical portion 330. Corner portions of the second exhaust flange portion 3321 when viewed in the central axis J1 direction expand from the outer peripheral surface of the f second cylindrical portion 330 towards the outside in the radial direction. Furthermore, the surfaces that constitute the sides of the second exhaust flange portion 3321 when viewed in the central axis J1 direction are each flush with the corresponding outer flat surface 336. Moreover, when viewed in the central axis J1 direction, the second intake flange portion 3311 and the second exhaust flange portion 3321 overlap each other.

The second cylindrical portion 330 includes a first inside diameter portion 333 and a second inside diameter portion 334. The first inside diameter portion 333 is disposed on the exhaust side with respect to the second inside diameter portion 334, in other words, the first inside diameter portion 333 is disposed on the lower side OS. The first inside diameter portion 333 is tubular, and an inside diameter D21 thereof does not change in the axial direction. The minimum inside diameter of the second cylindrical portion 330 is the inside diameter D21. In other words, the first inside diameter portion 333 is a minimum inside diameter portion. In the second cylindrical portion 330, the second inside diameter portion 334 is disposed on the upper end portion 331 side, in other words, the second inside diameter portion 334 is disposed at the end portion on the intake side. The portions of the second inside diameter portion 334 that overlap the outer flat surfaces 336 in the radial direction are inner flat surfaces 3341, and portions that connect the inner flat surfaces 3341 to each other in the circumferential direction are inner curved surfaces 3342. The inner curved surfaces 3342 include conical portions 335. Each conical portion 335 is a portion of a conical inner surface and the diameter of each conical portion 335 widens towards the upper side, in other words, the intake side.

The section of the uppermost side of each inner curved surface 3342 of the second inside diameter portion 334 cut along a plane orthogonal to the central axis has an arc shape and an inside diameter thereof is an inside diameter D22. Furthermore, the inside diameter D21 of the first inside diameter portion 333 is smaller than the inside diameter D22 of each inner curved surface 3342 of the second inside diameter portion 334.

Furthermore, when the first axial flow fan 2 and the second axial flow fan 3 are connected to each other, the second inside diameter portion 234 of the first cylindrical portion 230 and the second inside diameter portion 334 of the second cylindrical portion 330 are connected to each other in the axial direction in a continuous manner. In so doing, in order to connect the inner curved surfaces 2342 of the second inside diameter portion 234 of the first cylindrical portion 230 and the inner curved surfaces 3342 of the second inside diameter portion 334 of the second cylindrical portion 330 to each other in a smooth manner, the inside diameter D12 and the inside diameter D22 are the same.

Furthermore, in order to connect the inner flat surfaces 2341 of the second inside diameter portion 234 of the first cylindrical portion 230 and the inner flat surfaces 3341 of the second inside diameter portion 334 of the second cylindrical portion 330 to each other in a smooth manner, the inside diameter D11 and the inside diameter D12 are the same.

Furthermore, the lower end portion 332 of the second cylindrical portion 330 in the axial direction includes diameter expanded portions 337, in which the lower portions thereof in the axial direction are curved outwardly in the radial direction, at areas that overlap the corner portions of the second exhaust flange portion 3321 in the radial direction, in other words, in areas that overlap the inner curved surfaces 3342 of the second inside diameter portion 334 in the axial direction. The inside diameters of the diameter expanded portions 337 becomes gently larger as the diameter expanded portions 337 extend in the direction of the airflow. By shaping the diameter expanded portions 337 in the above manner, the airflow discharged through the second exhaust portion 3302 of the second cylindrical portion 330 does not become disrupted easily. When the diameter expanded portion 337 is cut along a plane including the central axis J1, the shape of the section is a curved surface. In other words, the diameter expanded portions 337 has a so-called bell-mouth shape.

In other words, the second housing 33 includes, at the end portion on the exhaust side, the square second exhaust flange portion 3321 that has sides that are each larger than the inside diameter of the inner circumferential surface of the second cylindrical portion 330. The portions of the end portion of the inner circumferential surface of the second cylindrical portion 330 on the exhaust side that overlap the corner portions of the second exhaust flange portion 3321 in the radial direction are curved outwards in the radial direction towards the edge on the exhaust side. With the above, by forming the diameter expanded portions 337 in shapes that expand gradually, even when compared with a case in which the diameter expanded portions 337 are formed as a cone, the airflow is not easily disturbed and decrease in the pressure and in the air volume can be suppressed.

The second axial flow fan 3 includes 11 second support ribs 34. The 11 second support ribs 34 extend from the second inside diameter portion 334 towards the inner side in the radial direction, and are disposed at equal intervals in the circumferential direction. Inner sides of the second support ribs 34 in the radial direction are connected to a base portion 3221 (described later) of the second motor portion 32. With the above, the second motor portion 32 is supported by the second housing 33 with the second support ribs 34. The second housing 33, the second support ribs 34, and the base portion 3221 are formed as a resin molded body formed in an integrated manner with resin. In the second axial flow fan 3, the second support ribs 34 are disposed on the upper end portion 331 side of the second housing 33. In other words, the second support ribs 34 extend from an inner circumferential surface of the second cylindrical portion 330 towards the inner side, and support the second motor portion 32.

When viewed in the central axis J1 direction, the second support ribs 34 are disposed inside the second cylindrical portion 330. In combination with the first support ribs 24 of the first axial flow fan 2, the second support ribs 34 are used as stator blades. Accordingly, the second support ribs 34 are inclined in the same directions as the first support ribs 24 when the second axial flow fan 3 is connected to the lower side OS of the first axial flow fan 2. In other words, the lower sides of the second support ribs 34 in the axial direction are positioned on the downstream side in the rotation direction of the first impeller 21.

The second motor portion 32 is of a so-called outer rotor type. As illustrated in FIG. 10, the second motor portion 32 includes a second rotor portion 321 and a second stator portion 322. The second motor portion 32 rotates the second impeller 31. The second stator portion 322 includes the base portion 3221, a bearing holding portion 3222, an armature 3223, and a circuit board 3224. The base portion 3221 is formed as an integrally molded body together with the second housing 33 and the second support ribs 34. The base portion 3221 has a disk shape orthogonal to the central axis J1. The center of the disk shape overlaps the central axis J1. The bearing holding portion 3222 has a cylindrical shape, is disposed at a center portion of the base portion 3221, and extends towards the lower side in the axial direction. Note that the bearing holding portion 3222 may be an integrally molded body molded together with the base portion 3221. A ball bearing 3225 and a ball bearing 3226 are attached to an upper portion and a lower portion inside the bearing holding portion 3222. Furthermore, a shaft 3213 (described later) of the second rotor portion 321 is rotatably supported through the ball bearing 3225 and the ball bearing 3226. Note that the ball bearing 3225 and the ball bearing 3226 are examples of bearings, and the bearings are not limited to the ball bearing 3225 and the ball bearing 3226. Bearing that are structured to rotatably support the shaft 3213 may be widely employed.

The armature 3223 is fixed external to the bearing holding portion 3222 in the radial direction. The armature 3223 includes a stator core 3227, a coil 3228, and an insulator 3229. The stator core 3227 is a stacked body in which electromagnetic steel sheets are stacked in the axial direction. Note that the stator core 3227 is not limited to a stacked body in which electromagnetic steel sheets are stacked, and may be a single member, such as a fired body of powder or a casting, for example.

The stator core 3227 includes an annular core back and a plurality of (nine, herein) teeth. The nine teeth extend towards the outside in the radial direction from an outer peripheral surface of the core back and are formed radially. With the above, the nine teeth are arranged in the circumferential direction. The coil 3228 is configured by winding a length of conducting wire around the teeth on which the insulator 3229 has been attached.

The core back of the stator core 3227 is press-fitted in the bearing holding portion 3222, and the stator core 3227 is fixed to the bearing portion 3222. The press-fitting may be a so-called stationary fit, or may be a light press-fit that is a so-called transition fit in which the press-fitting force is weaker than the press-fitting. The core back and the bearing holding portion 3222 may be fixed to each other by another method, such as adhesion. When the stator core 3227 is fixed to the bearing holding portion 3222, the center thereof overlaps the central axis J1. Furthermore, the nine teeth of the stator core 3227 are arranged at equal intervals in the circumferential direction to smoothly and efficiently rotate the second motor portion 32.

The circuit board 3224 is attached to the base portion 3221. The circuit board 3224 is electrically connected to the coil 3228 of the second stator portion 322. The circuit board 3224 includes a drive circuit that drives the coil 3228.

The base portion 3221 of the second stator portion 322 is an integrally molded body formed together with the second support ribs 34. With the above, the second stator portion 322, in other words, the second motor portion 32 is supported by the second support ribs 34. Furthermore, the second support ribs 34 are also an integrally molded body formed together with the second housing 33. Accordingly, the second motor portion 32 is connected to the second housing 33 through the second support ribs 34, in other words, the second motor portion 32 is supported by the second housing 33.

The second rotor portion 321 includes a yoke 3211, a field magnet 3212, the shaft 3213, and a shaft fixing member 3214. The yoke 3211 is made of metal and has a lidded cylindrical shape about the central axis J1. The shaft fixing member 3214 is fixed to the center of the lid-shaped portion of the yoke 3211. The shaft 3213 is fixed to the shaft fixing member 3214 with a fixing method, such as press-fitting.

Note that the fixing method is not limited to press-fitting and may be another method, such as adhesion. The yoke 3211 is fixed to the shaft 3213 through the shaft fixing member 3214.

The field magnet 3212 has a circular cylinder shape. The field magnet 3212 is fixed to an inner surface of the yoke 3211. The field magnet 3212 is magnetized to the N-pole and the S-pole alternately in the circumferential direction. Note that in place of the field magnet 3212 having a circular cylinder shape, a plurality of field magnets may be arranged in the circumferential direction.

The shaft 3213 is made of metal and has a columnar shape. The shaft 3213 is rotatably supported by the bearing holding portion 3222, in other words, by the f second stator portion 322 through the ball bearing 3225 and the ball bearing 3226. The center of the shaft 3213 rotatably supported by the bearing holding portion 3222 overlaps the central axis J1.

In the second motor portion 32, by having the shaft 3213 be rotatably supported through the ball bearing 3225 and the ball bearing 3226, the second rotor portion 321 is supported by the second stator portion 322 in a rotatable manner about the central axis J1. In the above, an inner surface of the field magnet 3212 of the second rotor portion 321 in the radial direction and an outer surface of the stator core 3227 in the radial direction oppose each other with a gap therebetween in the radial direction. An operation of the second motor portion 32 will be described in detail later.

As illustrated in FIGS. 9 and 10, the second impeller 31 includes a plurality of second blades 311, and a cup 312. The cup 312 has a lidded cylindrical shape. Note that while the cup 312 has a lidded cylindrical shape, the shape is not limited to the above, and may be a truncated cone shape in which the outside diameters of an outer peripheral surface differ in the axial direction.

The second blades 311 each protrude from the outer surface of the cup 312 in the radial direction towards the outside in the radial direction. The second impeller 31 is provided with seven second blades 311. The seven second blades 311 are aligned at equal intervals in the circumferential direction. In other words, the second impeller 31 includes the plurality of second blades 311 that extend outwards in the radial direction and that are arranged in the circumferential direction. The second blades 311 are inclined in the circumferential direction and generate an airflow from the upper side IS towards the lower side OS when the second impeller 31 is rotated. In other words, the second blades 311 are each inclined to a direction that generates an airflow from the upper side IS towards the lower side OS.

As described above, the second stator portion 322 of the second motor portion 32 is assembled by attaching the bearing holding portion 3222, the armature 3223, and the circuit board 3224 to the base portion 3221 formed integrally with the second housing 33. In other words, the second stator portion 322 is supported by the second housing 33 through the second support ribs 34.

Furthermore, the yoke 3211 of the second rotor portion 321 is fixed inside the cup 312 of the second impeller 31. The yoke 3211 may be fixed in the cup 312 by press-fitting or by adhesion. Furthermore, the yoke 2211 may be fixed with a fastening member, such as a screw. The cup 312 suppressing deviation from the yoke 3211 is fixed to the yoke 3211. In other words, the second impeller 31 is fixed to the second rotor portion 321.

Furthermore, the shaft 3213 of the second rotor portion 321 to which the second impeller 31 is fixed is fixed to the inner rings of the ball bearing 3225 and the ball bearing 3226 attached inside the bearing holding portion 3222. Note that while the shaft 3213 is fixed to the inner rings of the ball bearing 3225 and the ball bearing 3226 by press-fitting, the fixing method is not limited to press-fitting. For example, a fixing method, such as adhesion or welding, that suppresses the relative movement between the shaft 3213 and the inner rings, and that fixes the shaft 3213 about the central axis J1 in a rotatable manner can be widely employed. The second rotor portion 321 to which the second impeller 31 is attached is rotatably attached to the second stator portion 322 in the above manner.

By attaching the second rotor portion 321 to the second stator portion 322, the second impeller 31 is accommodated inside the second housing 33. The outer sides of the second blades 311 in the radial direction oppose the inner surface of the second cylindrical portion 330 in the radial direction. Furthermore, the second blades 311 are contained inside the length of the second cylindrical portion 330 in the axial direction. Furthermore, the gap in the radial direction between the inner surface of the second cylindrical portion 330 and the outer sides of the second blades 311 in the radial direction is uniform. Note that the gap between the inner surface of the second cylindrical portion 330 and the outer sides of the second blades 311 in the radial direction being uniform not only includes a case in which the gap is uniform in an accurate manner, but also includes a case in which the gap has variations that do not affect the operation of the second axial flow fan 3.

An electric current is supplied to the coil 3228 of the second motor portion 32 at a good timing from the drive circuit mounted on the circuit board 3224. With the above, the second rotor portion 321 of the second motor portion 32 is rotated in a predetermined direction. Note that, herein, the rotation direction of the second rotor portion 321 is anti-clockwise when viewing the central axis J1 from the upper side IS.

By rotating the second motor portion 32 about the central axis J1, the second impeller 31 fixed to the second rotor portion 321 is also rotated about the central axis J1. With the rotation of the second impeller 31, an airflow that, while swirling in the circumferential direction, flows in the axial direction is generated in the second housing 33, in other words, inside the second cylindrical portion 330.

Compared with the first blades 211 of the first axial flow fan 2, the inclination of each second blade 311 of the second axial flow fan 3 with respect to the shaft is small, and the pressure difference between each pressure surface and the corresponding negative pressure surface is small. Accordingly, suppression of pressure loss can be achieved without providing any auxiliary blade portions in the outer edge portions of the second blades 311 in the radial direction. Furthermore, in an impeller in which each blade has a small inclination with respect to the shaft, rather than an effect of compressing air, an effect of increasing the flow velocity is obtained more easily by rotation of the impeller. In other words, compared with the first axial flow fan 2, the ability of increasing the discharge flow rate is high in the second axial flow fan 3. In other words, compared with the second axial flow fan 3, the ability of increasing the discharge pressure is high in the first axial flow fan 2. In the serial axial flow fan 1, the above axial flow fans having different abilities are connected in series to increase the pressure and the flow rate. A detailed description of the serial axial flow fan 1 will be given next.

The serial axial flow fan 1 is formed by serially connecting the first axial flow fan 2 and the second axial flow fan 3 to each other in the axial direction. The lower end portion of the first axial flow fan 2 and the upper end portion of the second axial flow fan 3 are connected to each other. The first exhaust flange portion 2321 of the first axial flow fan 2 and the second intake flange portion 3311 of the second axial flow fan 3 are in contact with and are fixed to each other in the axial direction. Screwing can be cited as a method for fixing the first exhaust flange portion 2321 and the second intake flange portion 3311 to each other; however, the method is not limited to screwing. For example, adhesion can be cited as an example. The first exhaust portion 2302 of the first axial flow fan 2 and the second intake portion 3301 of the second axial flow fan 3 are connected to each other without any gap. With the above, air that has been discharged from the first exhaust portion 2302 of the first axial flow fan 2 can be prevented from leaking out through the connection between the first axial flow fan 2 and the second axial flow fan 3.

The first support ribs 24 are disposed on the exhaust side of the first axial flow fan 2. Furthermore, the second support ribs 34 are disposed on the intake side of the second axial flow fan 3. Furthermore, by connecting the first axial flow fan and the second axial flow fan 3 to each other in the axial direction, the surfaces of the first support ribs 24 facing the exhaust side and the surfaces of the second support ribs 34 facing the intake side overlap each other in the axial direction. Note that the surfaces of the first support ribs 24 that face the exhaust side and the surfaces of the second support ribs 34 that face the intake side may be in contact with each other, or gaps may be formed therebetween to the extent that turbulent flow is not created. In other words, the first support ribs 24 are disposed on the exhaust side of the first housing 23, the second support ribs 34 are disposed on the intake side of the second housing 33, and the surfaces of the first support ribs 24 that face the exhaust side and the surfaces of the second support ribs that face the intake side overlap each other in the axial direction. With the above configuration, the first support ribs 24 and the second support ribs 34 in combination form the stator blades. With the above, the velocity component of the airflow in the rotation direction can be oriented towards the axial direction, and the pressure and the flow rate in the axial direction can be increased.

When the first axial flow fan 2 and the second axial flow fan 3 are connected to each other, the inner flat surfaces 2341 of the second inside diameter portion 234 of the first cylindrical portion 230 and the inner flat surfaces 3341 of the second inside diameter portion 334 of the second cylindrical portion 330 are disposed on the same plane. Furthermore, the inner curved surfaces 2342 of the second inside diameter portion 234 of the first cylindrical portion 230 and the inner curved surfaces 3342 of the second inside diameter portion 334 of the second cylindrical portion 330 are disposed on the same circular cylindrical surface. With such a connection, the second inside diameter portion 234 of the first cylindrical portion 230 and the second inside diameter portion 334 of the second cylindrical portion 330 are connected to each other in the axial direction in a smooth manner.

In other words, the first housing 23 includes, at the end portion on the exhaust side, the square first exhaust flange portion 2321 that has sides that are each larger than the inside diameter of the inner surface of the first cylindrical portion 230. Furthermore, the second housing 33 includes, at the end portion on the intake side, the square second intake flange portion 3311 that has sides that are each larger than the inside diameter of the inner surface of the second cylindrical portion 330. The first exhaust flange portion 2321 and the second intake flange portion 3311 are connected to each other in the axial direction so as to overlap each other, and the inside diameter D12 of the end portion of the inner surface of the first cylindrical portion 230 on the exhaust side that overlaps the corner portions of the first exhaust flange portion 2321 in the radial direction, and the inside diameter D22 of the end portion of the inner surface of the second cylindrical portion 330 on the intake side that overlaps the corner portions of the second intake flange portion 3311 in the radial direction are larger than the minimum inside diameters D11 and D21, respectively, of the cylindrical portions 230 and 330, respectively, in the axial direction. By widening the connection between the first housing 23 and the second housing 33 outwards with respect to the first inside diameter portion 233 and the first inside diameter portion 333, the flow velocity of the airflow in the cylindrical portion is decreased. With the above, wind noise generated when the airflow passes the first support ribs 24 and the second support ribs 34 can be reduced. With the above, noise and (or) vibration can be suppressed. In other words, noise of the serial axial flow fan 1 can be reduced.

In the serial axial flow fan 1, the first axial flow fan 2 and the second axial flow fan 3 are driven at the same time. With the above, in the serial axial flow fan 1, air is drawn in through the first intake portion 2301 with the rotation of the first impeller 21. Furthermore, the first impeller 21 compresses and accelerates the air and discharges the air through the first exhaust portion 2302. The air that has been discharged through the first exhaust portion 2302 of the first axial flow fan 2, while being prevented from leaking to the outside, flows into the second axial flow fan 3 through the second intake portion 3301. In the second axial flow fan 3, the air that has flowed in is compressed and accelerated further with the rotation of the second impeller 31, and is discharged from the second exhaust portion 3302. In other words, in the serial axial flow fan 1, air is drawn in through the first intake portion 2301 at the end portion of the first axial flow fan 2 on the upper side IS, is compressed and accelerated with the first impeller 21 and the second impeller 31, and is discharged through the second exhaust portion 3302 at the end portion of the second axial flow fan 3 on the lower side. The second inside diameter portion 234 of the first cylindrical portion 230 and the second inside diameter portion 334 of the second cylindrical portion 330 are connected to each other in the axial direction in a smooth manner so that turbulence in the airflow is small and decreases in air volume and pressure can be suppressed. In the wind tunnel of the serial axial flow fan 1 formed by connecting the first cylindrical portion 230 and the second cylindrical portion 330 to each other, the inside diameter of the portion where the first axial flow fan 2 and the second axial flow fan 3 are connected to each other, in other words, the center portion in the axial direction, increases. With the above, the flow velocity of the airflow discharged through the first exhaust portion 2302 of the first axial flow fan 2 is decreased. With the above, the wind noise generated when the wind passes the first support ribs 24 disposed at the lower end portion of the first cylindrical portion 230, and the second support ribs 34 disposed on the intake side of the second housing 33 can be made smaller. By disposing the surfaces of the first support ribs 24 that face the exhaust side and the surfaces of the second support ribs 34 that face the intake side overlap each other in the axial direction, the first support ribs 24 and the second support ribs 34 constitute the stator blades. The lower sides OS of the first support ribs and the second support ribs 34 in the axial direction are inclined surfaces that are oriented towards the downstream side in the rotation direction of the first impeller 21. The airflow generated with the rotation of the first impeller 21 includes a velocity component that swirls in the rotation direction of the first impeller 21 and a velocity component in the axial direction. Furthermore, the velocity component of the airflow in the circumferential direction is bent in the axial direction with the stator blades formed by the first support ribs 24 and the second support ribs 34. With the above, the pressure and the flow velocity in the axial direction can be increased. Furthermore, by providing a gap between the first support ribs 24 and the second support ribs 34, direct transmission of the vibration of the armature 2223 and the vibration of the armature 3223 to each other can be suppressed, and large vibration and (or) noise generated by interference between the vibrations can be suppressed from occurring. In other words, noise of the serial axial flow fan 1 can be reduced.

The first axial flow fan 2 includes auxiliary blade portions 213 in the outer edges of the first blades 211 of the first impeller 21 in the radial direction, and increases the pressure of the airflow discharged through the first exhaust portion 2302. Airflow with high pressure is discharged from the first axial flow fan 2. Furthermore, the airflow with a high pressure discharged through the first exhaust portion 2302 of the first axial flow fan 2 flows into the second axial flow fan 3 through the second intake portion 3301.

Meanwhile, the second axial flow fan 3 has a larger number of blades compared with the number of the first blades 211 of the first impeller 21, and the inclination of the blades of the second axial flow fan 3 with respect to the shaft is smaller than the inclination of the first blades 211. Accordingly, the effect of increasing the flow rate of the airflow is larger in the second axial flow fan 3 than that in the first axial flow fan 2. The airflow from the first axial flow fan 2 having a high pressure is accelerated in the second axial flow fan 3 to increase the flow rate. With the above, the serial axial flow fan 1 is capable of discharging an airflow having a high pressure and a large low rate. As described above, by providing the auxiliary blade portions 213 in the outer edge portions of the first blades 211 of the first impeller 21 in the radial direction, the first axial flow fan 2 increases the pressure of the airflow generated by the first impeller 21. The first axial flow fan 2 has a high pressure increasing effect. The second axial flow fan 3 has a high flow velocity increasing effect, in other words, a high flow rate increasing effect.

Features of the serial axial flow fan 1 according to the present disclosure were evaluated through computer simulations. Simulations were conducted by changing Nin, Nout, and Nrib of the serial axial flow fan 1, where Nin is the number of blades of the impeller of the axial flow fan on the intake side, Nout is the number of blades of the impeller of the axial flow fan on the exhaust side, and Nrib is the number of first support ribs and the number of second support ribs. Note that in the configuration assuming the present disclosure, auxiliary blade portions in which the outer sides thereof are warped towards the intake side were formed in the outer edge portions of the blades of the impeller of the axial flow fan in the radial direction.

A maximum efficiency point, the discharge pressure, and the flow rate of an example of the conventional art including no auxiliary blades were measured, in a case in which Nin=5, Nout=7, and Nrib=11. Furthermore, measurements that are the same as those of the example of the conventional art were measured in a configuration, serving as the exemplary embodiment, satisfying Nin=5, Nout=7, and N=11 and including auxiliary blade portions in the outer edge portions of the blades on the intake side in the radial direction.

As a result, while the maximum efficiency point of the example of the conventional art was 46%, that of the exemplary embodiment was increased to 47%. Furthermore, regarding the pressure in a case in which the flow rate of the discharged airflow was 4.0 $m^3$/min, while the example of the conventional art was about 1230 Pa, the exemplary embodiment was about 1250 Pa. In the above case, while the input shaft power of the example of the conventional art was 168 W, that of the exemplary embodiment was 165 W.

The maximum efficiency point of the exemplary embodiment was higher than that of the example of the conventional art, as well as the pressure under the same flow rate. Furthermore, although the pressure-flow characteristics of the exemplary embodiment was higher than that of the example of the conventional art, the input shaft power was lower.

As a result of the simulation, it was understood that in the configuration satisfying Nin<Nout<Nrib, when the auxiliary blade portions were provided in at least either of the blades on the intake side and the blades on the exhaust side, there were cases in which the efficiency was higher, the pressure was higher, and the air volume was larger than a case in which there was no auxiliary blade.

Note that Nin, Nout, and Nrib are a set of prime integers. In other words, Nin, Nout, and Nrib are a set of integral numbers that do not have a common divisor other than 1. With such a configuration, vibrational resonance between the first impeller 21, the second impeller 31, the first support ribs 24, and the second support ribs 34 is suppressed. Noise caused by resonance is suppressed and the noise of the serial axial flow fan 1 can be reduced.

Furthermore, while changing Nin, Nout, and Nrib, similar simulations were as carried out with a configuration satisfying Nin<Nout<Nrib, in which auxiliary blade portions were provided at the blades on the intake side. A case satisfying (Nin, Nout, Nrib)=(5, 7, 11) was assumed as the exemplary embodiment, (Nin, Nout, Nrib)=(4, 7, 11) as a first comparative example, (Nin, Nout, Nrib)=(5, 9, 11) as a second comparative example, (Nin, Nout, Nrib)=(5, 11, 11) as a third comparative example, and (Nin, Nout, Nrib)=(5, 7, 13) as a fourth comparative example.

Furthermore, when the flow rate of the discharged air was 4.0 $m^3$/min, the pressure in the first comparative example was about 800 kPa, the pressure in the second comparative example was about 990 kPa, the pressure in the third comparative example was about 1150 kPa, and the pressure in the fourth comparative example was about 990 kPa in the.

The number Nin of the blades of the impeller of the axial flow fan on the intake side was five in the exemplary embodiment and was four in the first comparative example. It was understood that a pressure difference is created in the discharged air depending on the number Nin of the blades of the impeller of the axial flow fan on the intake side.

The number Nout of the blades of the impeller of the axial flow fan on the exhaust side was seven in the exemplary embodiment and was nine in the third comparative example. It was understood that a pressure difference is also created in the discharged air depending on the number Nout of the blades of the impeller of the axial flow fan on the exhaust side. The pressure of the discharged air was larger in the case of Nout=11 than in the case of Nout=9. Moreover, it was understood that in the case of Nout=7, the pressure of the discharged air was even more larger.

Moreover, the number Nrib of the first support ribs and the number Nrib of the second support ribs in the exemplary embodiment were 11, and those in the fourth comparative example were 13. It was understood that a pressure difference is created in the discharged air depending on the number Nrib of the first support ribs and that of the second support ribs. The pressure of the discharged air was larger in the case of Nrib=11 than in the case of Nrib=13.

In other words, the pressure-flow characteristics of the discharged airflow in the exemplary embodiment was higher compared with the first to fourth comparative examples.

Furthermore, as a result of conducting more simulations, it was confirmed that a configuration in which the auxiliary blade portions were provided in the blades and in which Nin=5 was satisfied was most optimum in increasing the airflow. Furthermore, by satisfying Nout=7, it was possible to increase the inclination and maintain the blade areas of each blades, and it was confirmed that Nout=7 is most optimum in increasing the air volume. Furthermore, by satisfying Nrib=11, it was confirmed that the largest pressure and the largest wind force could be obtained while obtaining the required mechanical strength to support the first motor portion and the second motor portion in a stable manner at the maximum efficiency point.

In the exemplary embodiment, the first impeller 21 and the second impeller 31 rotate in the same direction. Accordingly, by having the velocity component of the airflow discharged in the circumferential direction from the first axial flow fan 2 and the rotation direction of the second impeller 31 be the same, the speed of the airflow in the rotation direction relative to the speed of the end portions of the second blades 311 of the second impeller 31 on the upstream side becomes small; accordingly, the vibration and noise can be suppressed. In other words, noise of the serial axial flow fan 1 can be reduced. Furthermore, since the above direction is the same as the direction of the airflow flowing into the second blades 311, resistance of the second blades 311 can be suppressed. With the above, the input shaft power can be suppressed.

Note that the second blades 311 of the second impeller may be inclined to opposite directions, and the rotation direction of the second impeller 31 may be opposite to the rotation direction of the first impeller 21. With the above, the effect of the second blades 311 of the second impeller 31 bending the velocity component of the airflow in the rotation direction in the axial direction becomes larger. With the above, the pressure of the airflow discharged from the serial axial flow fan 1 can be increased.

Furthermore, while the present embodiment includes the first axial flow fan 2 in which the auxiliary blade portions 213 are provided at the outer edge portions of the first blades 211 in the radial direction, the configuration is not limited to the above. The auxiliary blade portions may be provided at the outer edge portions of the second blades 311 in the radial direction, which are provided in the second axial flow fan 3. Furthermore, the auxiliary blade portions may be provided at both of the outer edge portions of the first blades and the second blades in the radial direction. In other words, at least either of the first blades 211 and the second blades 311 are provided with the auxiliary blade portions 213.

Important capacities of the axial flow fan include pressure and air volume. The serial axial flow fan 1 of the present disclosure can, overall, obtain a high pressure and a large air volume at the time of maximum efficiency by separating the two impellers 21 and 31 into an impeller for pressure (the first impeller 21) and an impeller for air volume (the second impeller 31). In other words, by adding the auxiliary blades (the auxiliary blade portions 213) to the impeller (the first impeller 21), a high pressure can be obtained and the impeller can be used as an impeller for pressure. The impeller for pressure (the first impeller 21) has a large pressure difference in each pressure surface and the corresponding negative pressure surface. Accordingly, air leaks through the gap between the outer peripheral portion of the impeller (the first blades 211), and the housing inner circumferential surface (the inner circumferential surface of the first cylindrical portion 230), and pressure loss becomes large. The pressure loss can be reduced by providing the auxiliary blades (the auxiliary blade portions 213) at the outer peripheral portion of the impeller (the first impeller 21). Meanwhile, by not providing any auxiliary blades in the impeller (the second impeller 31), the impeller can be used as an impeller for air volume having a large air volume. The impeller for air volume (the second impeller 31) pushes the air with the entire surface to obtain a large air volume. As described above, by combining the impeller for pressure (the first impeller 21) and the impeller for air volume (the second impeller 31), an airflow with high pressure and a large air volume can be obtained.

While the exemplary embodiment of the present disclosure has been described above, the exemplary embodiment can be modified in various ways within the scope of the present disclosure.

The serial axial flow fan according to the present disclosure may be, for example, used as a cooling fan that sends air to electronic components disposed inside devices, such as a computer, a network communication device, and a server, and cool the electronic components.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A serial axial flow fan comprising:

a first axial flow fan that blows out air drawn in from an intake side to an exhaust side;

a second axial flow fan connected to the first axial flow fan along a central axis of the first axial flow fan, the second axial flow fan blowing out the air drawn in from an intake side to an exhaust side, wherein an end portion of the first axial flow fan on the exhaust side and an end portion of the second axial flow fan on the intake side are connected to each other;

the first axial flow fan including a first impeller that rotates about the central axis, a first motor portion that rotates the first impeller, a first housing that includes a first cylindrical portion that surrounds an outside of the first impeller in a radial direction, and a first support rib that extends inwards from an inner surface of the first cylindrical portion and that supports the first motor portion;

the first impeller including a plurality of first blades that extend outwards in the radial direction and that are arranged in a circumferential direction;

the second axial flow fan including a second impeller that rotates about the central axis, a second motor portion that rotates the second impeller, a second housing that includes a second cylindrical portion that surrounds an outside of the second impeller in the radial direction, and a second support rib that extends inwards from an inner surface of the second cylindrical portion and that supports the second motor portion; and the second impeller including a plurality of second blades that extend outwards in the radial direction and that are arranged in the circumferential direction, wherein either the first blades or the second blades, is provided with auxiliary blade portions, the first housing includes a first exhaust flange portion that has a square shape at an end portion on the exhaust side, the first exhaust flange portion including sides that are each larger than an inside diameter of the inner surface of the first cylindrical portion, the second housing includes a second intake flange portion that has a square shape at an end portion on the intake side, the second intake flange portion including sides that are each larger than an inside diameter of the inner surface of the second cylindrical portion, the first exhaust flange portion and the second intake flange portion are connected to each other so as to overlap each other in an axial direction, and an inside diameter of an end portion of the inner surface of the first cylindrical portion on the exhaust side that overlaps corner portions of the first exhaust flange portion in the radial direction, and an inside diameter of an end portion of the inner surface of the second cylindrical portion on the intake side that overlaps corner portions of the second intake flange portion in the radial direction are larger than a minimum inside diameter of the first cylindrical portion in the axial direction and a minimum inside diameter of the second cylindrical portion in the axial direction, the inner surface of the first cylindrical portion and the inner surface of the second cylindrical portion each include inner flat surfaces and inner curved surfaces, the total of the lengths of the inner flat surfaces being shorter than the total of the lengths of the inner curved surfaces, and the first support rib extends from one of the inner flat surfaces and one of the inner curved surfaces of the inner surface of the first cylindrical portion and the second support rib extends from one of the inner flat surfaces and one of the inner curved surfaces of the inner surface of the second cylindrical portion.

2. The serial axial flow fan according to claim 1, wherein the auxiliary blade portions are provided at outer edge portions of the first blades in the radial direction.

3. The serial axial flow fan according to claim 2, wherein the auxiliary blade portions are each formed in an entire area of a corresponding outer edge portion from a front end in a rotation direction to a rear end in the rotation direction.

4. The serial axial flow fan according to claim 2, wherein outsides of the auxiliary blade portions in the radial direction are warped towards the intake side.

5. The serial axial flow fan according to claim 2, wherein the auxiliary blade portions are contained inside a length of the first cylindrical portion in the axial direction.

6. The serial axial flow fan according to claim 2, wherein a gap between a side of the inner surface of the first cylindrical portion that opposes the auxiliary blade portions in the radial direction, and the outsides of the auxiliary blade portions is uniform.

7. The serial axial flow fan according to claim 2, wherein in the inner surface of the first cylindrical portion or the second cylindrical portion, at least a portion that opposes the auxiliary blade portions in the radial direction is a circular cylinder.

8. The serial axial flow fan according to claim 1, wherein the first support rib is disposed on the exhaust side of the first housing, wherein the second support rib is disposed on the intake side of the second housing, and wherein a surface of the first support rib that faces the exhaust side and a surface of the second support rib that faces the intake side overlap each other in the axial direction.

9. The serial axial flow fan according to claim 1, wherein the second housing includes a second exhaust flange portion that has a square shape provided at an end portion on the exhaust side, the second exhaust flange portion having sides that are each larger than the inside diameter of the inner surface of the second cylindrical portion, wherein a portion of an end portion of an inner surface of the second cylindrical portion on the exhaust side that overlaps corner portions of the second exhaust flange portion in the radial direction is curved outwards in the radial direction towards an edge on the exhaust side.

10. The serial axial flow fan according to claim 1, wherein the auxiliary blade portions are provided on the first blades.

11. The serial axial flow fan according to claim 1, wherein the inner flat surfaces and the inner curved surfaces are respectively provided on the exhaust side of the first axial flow fan and the intake side of the second axial flow fan.

12. The serial axial flow fan according to claim 1, wherein the inner curved surfaces include conical portions which include widening diameters.

* * * * *